US005518370A

United States Patent [19]

Wang et al.

[11] Patent Number: 5,518,370

[45] Date of Patent: May 21, 1996

[54] PORTABLE ELECTRIC FAN WITH SWIVEL MOUNT

[75] Inventors: Jui-Shang Wang, Taipei, Taiwan; Rodney Jané, Westboro; John Longan, Natick, both of Mass.; Stanley Gresens, Homewood, Ill.; Gregory Holderfield, Oak Park; Steven Valentor, Westmont, Ill.

[73] Assignee: Duracraft Corporation, Southborough, Mass.

[21] Appl. No.: 415,917

[22] Filed: Apr. 3, 1995

[51] Int. Cl.[6] ..... F04D 29/60

[52] U.S. Cl. ..... 416/246; 416/147

[58] Field of Search ..... 416/246, 247 R, 416/147

[56] References Cited

U.S. PATENT DOCUMENTS 3,591,309 7/1971 Ray ..... 416/247

5,429,481 7/1995 Liu ..... 416/246

FOREIGN PATENT DOCUMENTS 0197767 9/1985 Japan ..... 416/247 R

*Primary Examiner*—Edward K. Look
*Assistant Examiner*—Mark Sgantzos
*Attorney, Agent, or Firm*—John E. Toupal; Harold G. Jarcho

[57] ABSTRACT

A portable electric fan including a base having an upwardly directed coupling surface and a bottom surface for mounting on a foundation; a support having a downwardly directed coupling surface rotatably mounted on the upwardly directed coupling surface; a housing fixed to the support so as to be movable therewith, a fan blade retained by the housing; and an electric motor operatively coupled to said fan blade and energizable to produce rotation thereof. The coupling surfaces are shaped and arranged to produce in response to rotation of the support relative to the base, movement of the housing having both horizontal and vertical components.

20 Claims, 7 Drawing Sheets

PORTABLE ELECTRIC FAN WITH SWIVEL MOUNT

BACKGROUND OF THE INVENTION

The present invention relates generally to a portable electric fan and, more particularly, to a portable electric fan having a base that facilitates selective positioning of a fan housing to provide varied air flow paths.

Portable electric fans are used extensively to enhance personal comfort by inducing air movement. Included among the wide variety of existing fans are so called table fans arranged for mounting on planar surfaces of tables, desks and the like. Table fans can be moved easily to different locations in which air movement is desired and many include mechanisms for selective adjustment in the direction of air flow produced. However, prior adjustment mechanisms have suffered certain deficiencies such as limited flexibility, structural complexity, and high cost.

The object of this invention, therefore, is to provide a portable electric fan with an improved mechanism for accommodating selective directional air flow.

SUMMARY OF THE INVENTION

The invention is a portable electric fan including a base having an upwardly directed coupling surface and a bottom surface for mounting on a foundation; a support having a downwardly directed coupling surface rotatably mounted on the upwardly directed coupling surface; a housing fixed to the support so as to be movable therewith, a fan blade retained by the housing; and an electric motor operatively coupled to said fan blade and energizable to produce rotation thereof. The coupling surfaces are shaped and arranged to produce in response to rotation of the support relative to the base, movement of the housing having both horizontal and vertical components. Selective orientation of the fan housing to establish a desired direction of air flow is obtained easily by producing relative rotational movement between the coupling surfaces.

According to one feature of the invention, each of the coupling surfaces is inclined. The inclined coupling surfaces produce the desired horizontal and vertical components of movement.

According to another feature, the fan includes a detent mechanism for establishing a plurality of predetermined different relative rotational positions between the coupling surfaces in response to rotation of the support relative to the base. The detent mechanism facilitates establishment of a stable selected fan housing orientation.

According to other features of the invention, the detent mechanism includes a rack gear having a plurality of annularly spaced apart teeth, and another gear having at least one tooth sequentially engageable with the teeth during rotation of the support relative to the base. The desired detenting function is provided efficiently by the engaging gears.

According to yet another feature, the fan includes a stop preventing more than 360° of relative rotational movement between the coupling surfaces. The stop limits rotation to prevent entanglement of electrical wires.

According to further features of the invention, the support includes a cylindrical outer support surface having an elliptical cross-section, and the base includes a cylindrical outer base surface having an elliptical cross-section and aligned with the support surface. The elliptical support and base surfaces remain aligned during relative rotation between the coupling surfaces.

According to additional features of the invention, each of the outer base surface and the outer support surface is a truncated cylinder, the fan includes an on-off electrical switch operatively connected to the electric motor, the truncated outer support surface has longitudinally projecting portions of length uniformly varying between maximum and minimum values, and the switch is retained by the portion having the length of maximum value. This feature insures ready accessibility of the switch in all rotational positions of the support.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
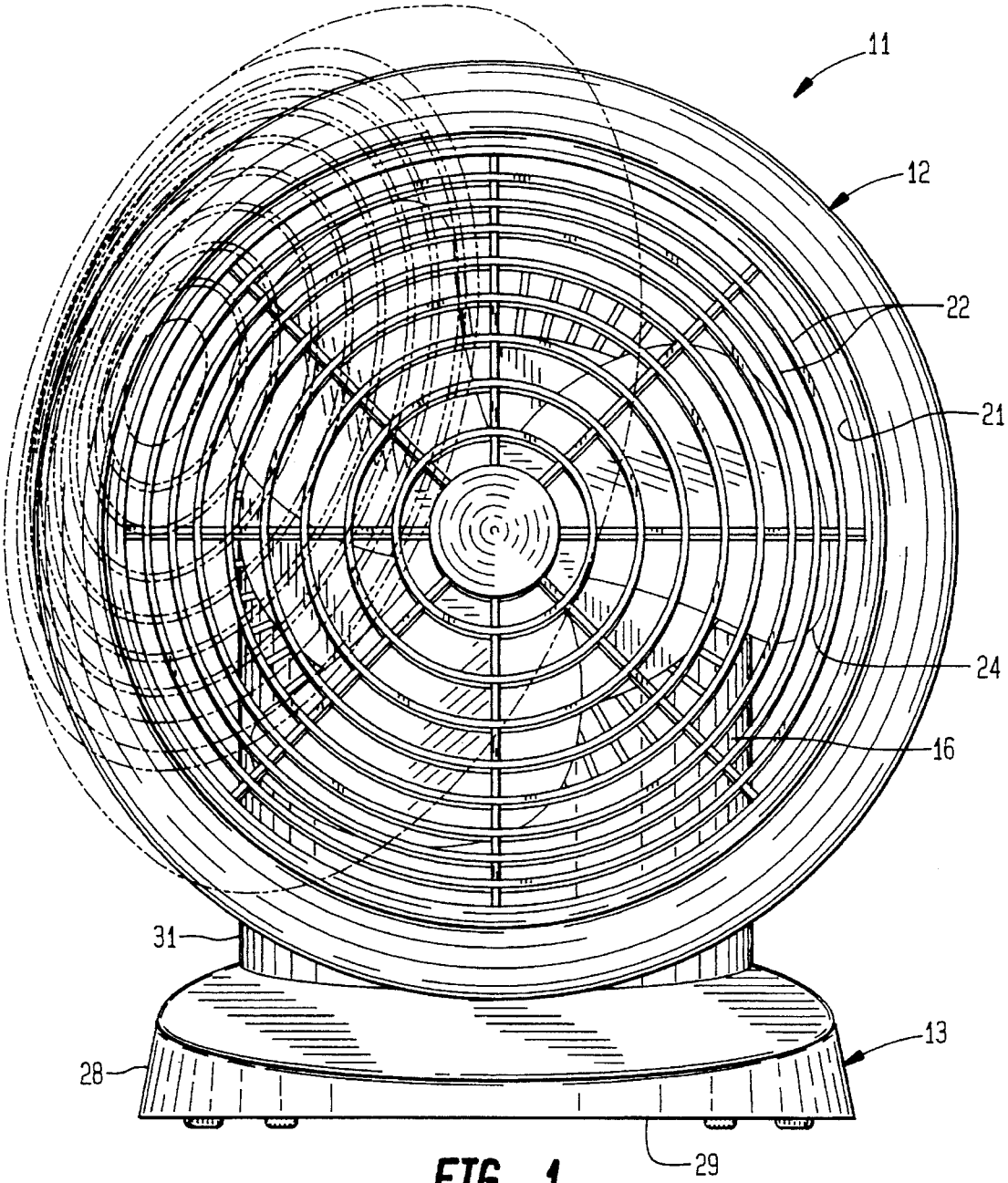
FIG. 1 is a front view of a portable fan.

A fan 11 includes a housing 12 supported on a base 13 by a support member 14. The housing 12 is fixed to the support member 14 so as to be movable therewith. Formed by the housing 12 is a fan enclosure 16 that defines an inlet opening 17 covered by an inlet grill 18 and an outlet opening 21 covered by an outlet grill 22. A fan blade 24 is mounted for rotation within the fan enclosure 16 to produce air flow between the inlet opening 17 and the outlet opening 21. Operatively coupled to the fan blade 24 is an electric motor 25.

Figure 5:
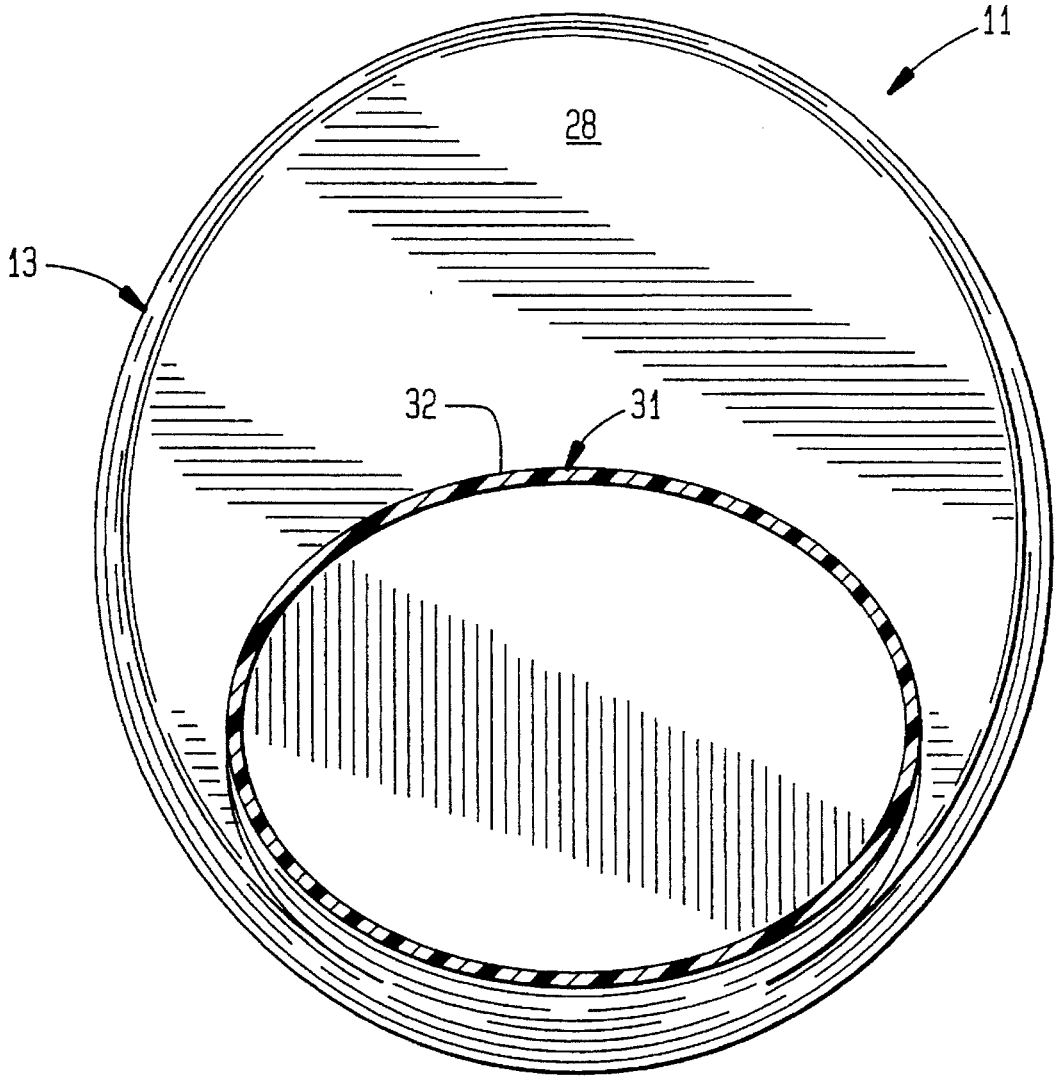
FIG. 5 is a cross-sectional view taken along lines 5—5 of FIG. 4.
Figure 7:
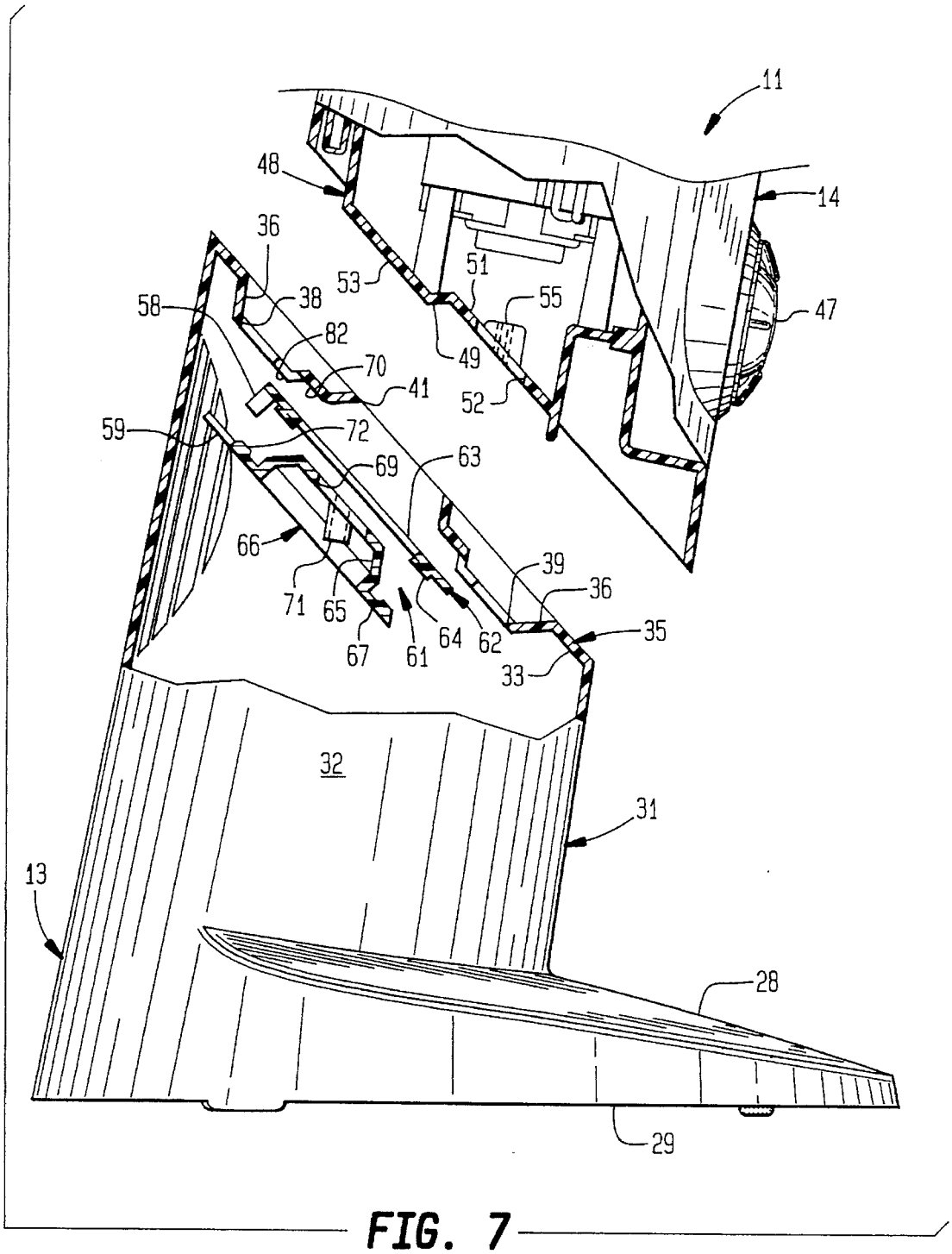
FIG. 7 is an exploded view illustrating a detent mechanism of the fan.

The base 13 includes a pedestal portion 28 having a bottom surface 29 for mounting on a suitable foundation such as a table or desk and an upwardly projecting upright portion 31 having vent openings 30 that communicate with the fan enclosure 16 through the support member 14. Defined by the upright portion 31 is a cylindrical outer base surface 32 having a non-circular cross-section in the form of an ellipse as shown in FIG. 5. In addition, the cylindrical upright portion 31 is truncated at its upper end closed by a wall 33 forming an upwardly directed inclined coupling surface 35. Formed in the upwardly directed surface 35 is an annular recess 36 having diametrically spaced apart opening 38, 39 and surrounding a central opening 41 illustrated in FIG. 7.

The support member 14 also is in the form of a truncated cylinder with an outer support surface 43 having a non-circular cross-section in the shape of an ellipse matching the ellipse formed by the upright portion 31. Longitudinally projecting portions of the outer support surface 43 have lengths uniformly varying between a minimum length portion 45 and a maximum length portion 46. Retained by the maximum length portion 46 is an electrical on-off switch 47 connected by control circuitry (not shown) to the electric motor 25. The lower end of the truncated cylindrical support member 14 is closed by a wall 48 forming an inclined, downwardly directed, coupling surface 49 rotatably mounted on the upwardly directed coupling surface 25 of the base upright portion 31. Defined by the wall 48 is an upwardly stepped portion 51 having an opening 52 and a downwardly stepped portion 53 received by the annular recess 36 in the upwardly directed coupling surface 35. A pair of internally threaded bosses 55 project upwardly from the stepped portion 51 on opposite sides of the opening 52. Formed on a wafer 62 is a base stop 58 (FIGS. 6 and 7) that engages a support stop 59 on a retainer 66: described hereinafter. The stops 58, 59 limit rotation of the support member 14 on the base 13 to 360°. That prevents undesirable entanglement of electrical cords (not shown) retained within cavities formed in the upright portion 31 and the support member 14.

Figure 6:
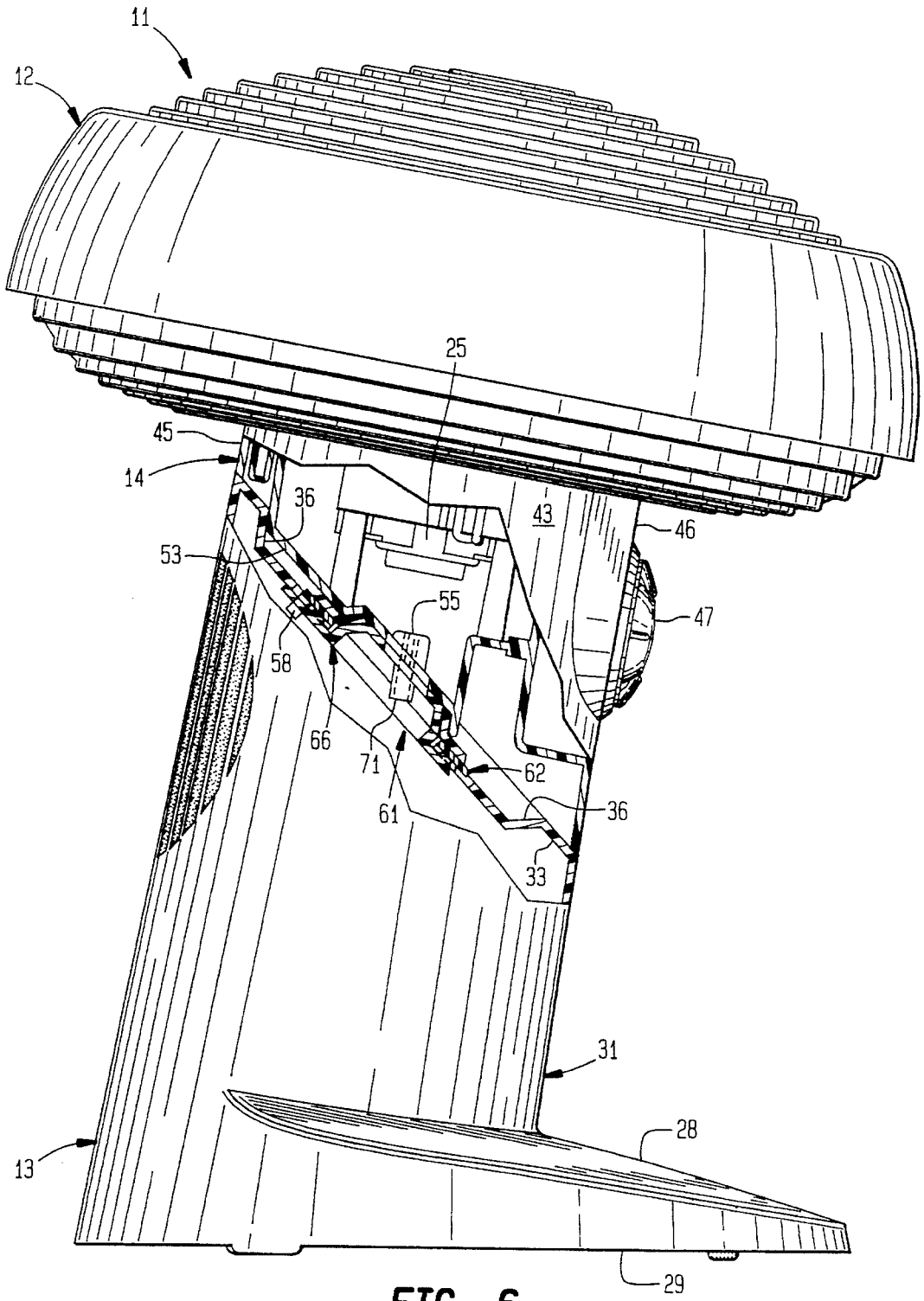
FIG. 6 is a partial sectional view of the fan shown in FIG. 1 with a fan housing portion in a different operating position.

Also provided in the electric fan 11 is a detent mechanism 61 depicted in FIG. 6. The detent mechanism 61 includes the first wafer rack gear member 62 having a central hole 63. Formed on a bottom surface of the wafer gear 62 are a plurality of annularly spaced apart gear teeth 64. Another component of the detent mechanism 61 is a retainer 66 having a cup-shaped central portion 65 and an outwardly directed flange portion 67 projecting radially outwardly from an open end thereof. Defined by the central portion 65 is a central opening 69 aligned with the hole 63 in the wafer 62 and the opening 41 in the coupling surface 35. On opposite sides of the opening 69 are a pair of downwardly directed, internally threaded bosses 71, each of which is aligned, respectively, with one of the bosses 55 on the wall 48. A pair of gear teeth 72 are formed in diametrically opposed positions on the annular flange 67 and project upwardly therefrom to engage the gear teeth 64 of the wafer gear 62.

The gear wafer 62 is sandwiched between a lower surface portion of the wall 33 and an upper surface of the flange portion 67 of the retainer 66. Screws (not shown) accommodated by the bosses 55 on the wall 48 and the bosses 71 on the cup shaped portion 65 to securely fix the retainer 66 to the support member 14. In addition, the wafer gear 62 is fixed by means (not shown) to the wall 33 of the upright portion 31. Thus, during rotation of the support member 14, the teeth 64 of the wafer gear 62 are sequentially engaged by the teeth 72 on the flange portion 67 of the retainer 66.

During use of the electric fan 11, the bottom surface 29 of the base 13 is placed on a suitable foundation. The attached combination of the housing 12 and the support member 14 then can be rotated on the upright portion 31 into a position wherein the rotating fan blade 24 produces air flow in a desired direction out of the outlet opening 21. During Such rotational adjustment of the combined housing 12 and support member 14, the downwardly stepped portion 53 of the coupling surface 49 rides in the annular seat formed by the annular recess 36 of the upwardly directed coupling surface 35. In addition, the rotary motion moves the second gear teeth 72 of the retainer 66 into sequential engagement with the teeth 64 of the first gear 62 so as to establish stable, manually releaseable different rotational positions of a housing 12 on the upright member 31.

Figure 2:
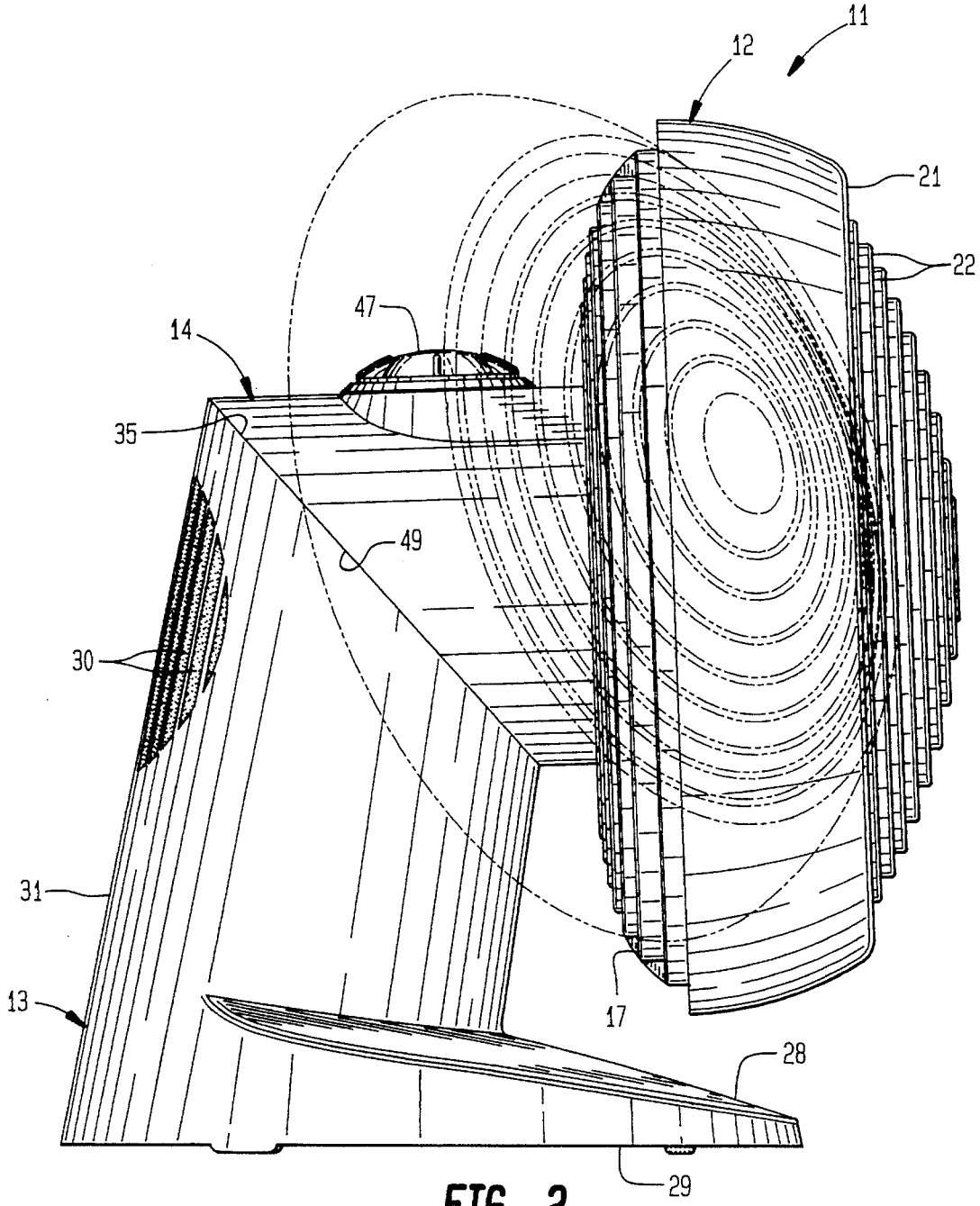
FIG. 2 is a side view of the fan shown in FIG. 1.
Figure 3:
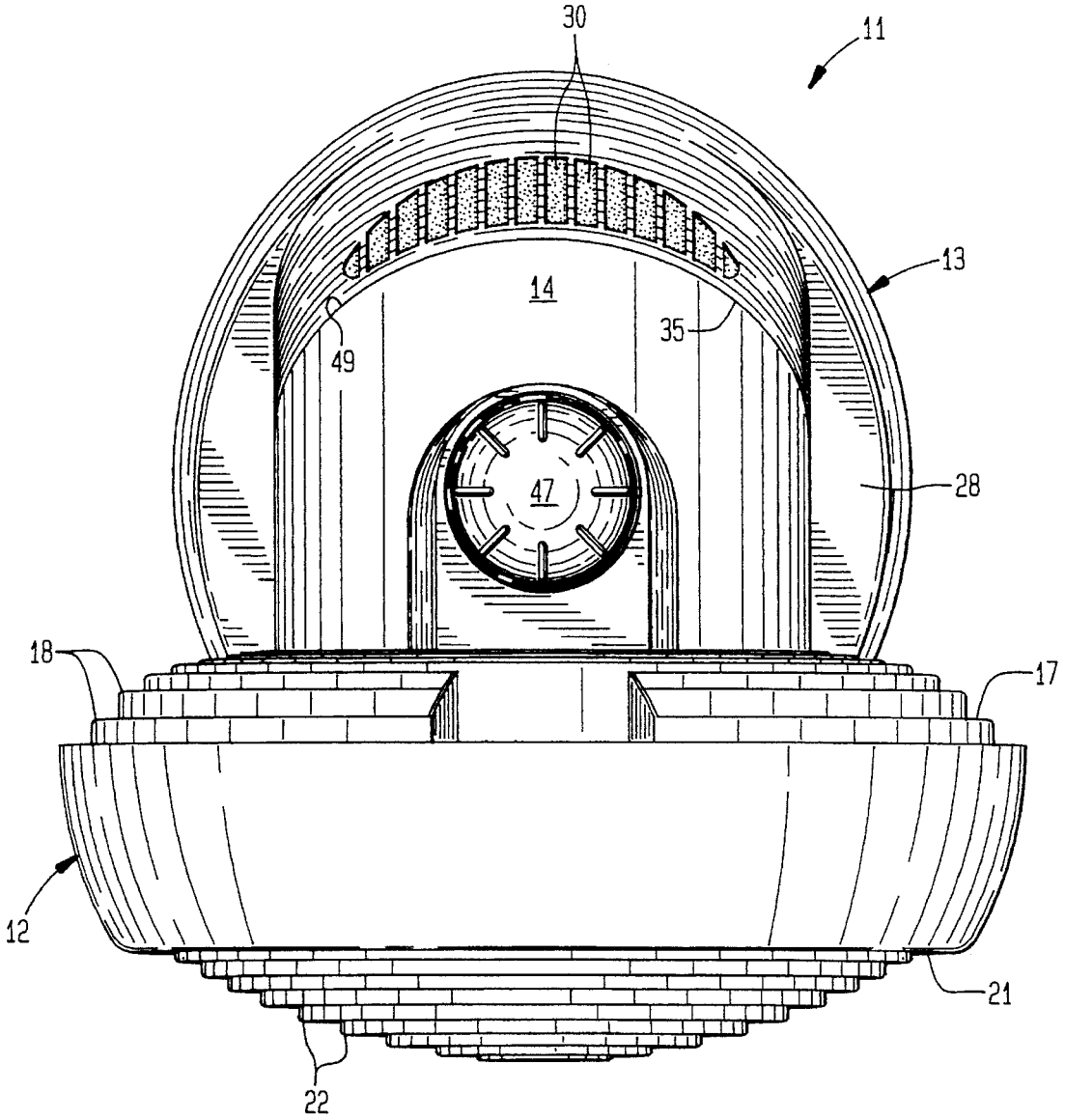
FIG. 3 is a top view of the fan shown in FIG. 1.
Figure 4:
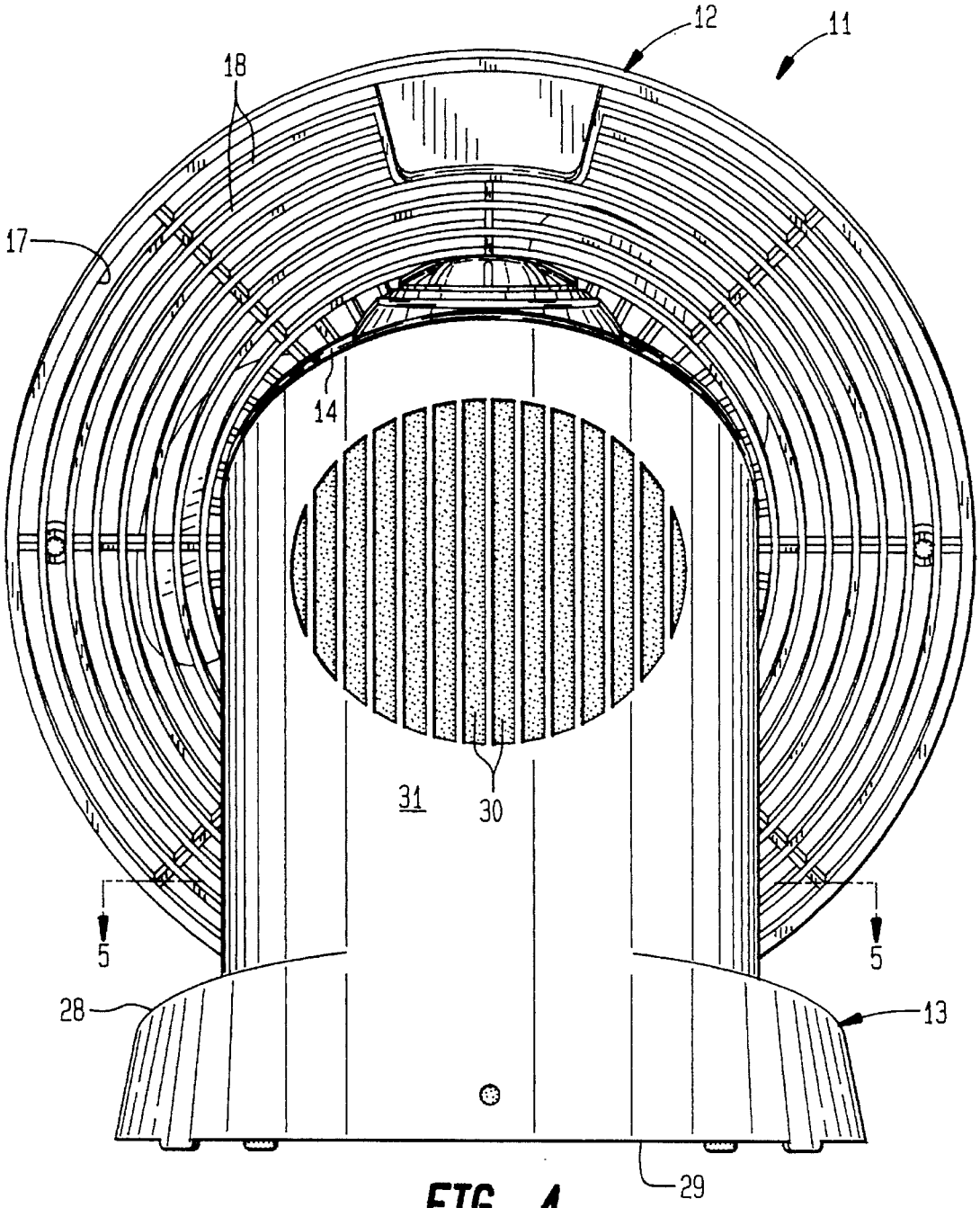
FIG. 4 is a rear view of the fan shown in FIG. 1.

Because of the inclination of the downwardly directed coupling surface 49 and the upwardly directed coupling surface 35, rotation of the support member 14 on the upright portion 31 of the base 13 produces for the fan housing 12 movement that includes horizontal and vertical components as shown by dashed lines in FIGS. 1 and 2. The support member 14 can be rotated 180° in opposite directions between extreme positions that provide for the housing 12 the orientations shown, respectively, in FIGS. 2 and 6. Accordingly, a wide variety of operating positions are established by a single, manual manipulation producing rotation of the support member 14 on the upright member 31. The housing position shown in FIG. 6 produces substantially vertically upwardly directed air flow and the housing position shown in FIG. 2 produces substantially horizontally directed air flow. In the latter position, the on-off switch 47 retained on the maximum length portion 46 of the outer support surface 43 is directed upwardly so as to be readily accessible to a user. In addition, because of the elliptical shape of their cross-sections, the outer support surface 43 of the support member 14 and the outer base surface 32 of the upright portion 31 remain aligned in all operating positions so as to prevent undesirable displacements therebetween. Also air movement produced by the rotating fan blade 24 in response to energization of the electric motor 25 induces between the vent openings 30 and the outlet opening 21 of the housing 12 air flow that cools the motor 25.

Obviously, many modifications and variations of the present invention are possible in light of the above teachings. It is to be understood, therefore, that the invention can be practiced otherwise than as specifically described.

What is claimed is:

1. A portable electric fan comprising:

base means having an upwardly directed coupling surface and a bottom surface for mounting on a foundation surface;

support means having a downwardly directed coupling surface rotatably mounted on said upwardly directed coupling surface;

housing means fixed to said support means so as to be movable therewith, and wherein said coupling surfaces are shaped and arranged to produce in response to rotation of said support means relative to said base means movement of said housing means having both horizontal and vertical components;

a fan blade retained by said housing means; and an electric motor coupled to said fan blade and energizable to produce rotation thereof.

2. A portable electric fan according to claim 1 wherein each of said coupling surfaces is inclined.

3. A portable electric fan according to claim 2 including detent means for establishing a plurality of predetermined different relative rotational positions between said coupling surfaces in response to rotation of said support relative to said base means.

4. A portable electric fan according to claim 3 wherein said detent means comprises a first gear fixed to said base means and a second gear fixed to said support means and engaged with said first gear.

5. A portable electric fan according to claim 4 wherein one of said first and second gears is a rack gear having a plurality of annularly spaced apart teeth, and the other of said first and second gears comprises at least one tooth sequentially engageable with said teeth during rotation of said support means relative to said base means.

6. A portable electric fan according to claim 5 wherein said housing means comprises a fan enclosure defining an inlet opening and an outlet opening, said fan enclosure enclosing said fan blade in a position to produce in response to rotation thereof air flow between said inlet opening and said outlet opening.

7. A portable electric fan according to claim 2 including stop means preventing more than 360° of relative rotational movement between said coupling surfaces.

8. A portable electric fan according to claim 7 wherein said support means comprises a cylindrical outer support surface having a non-circular cross-section, and said base means comprises a cylindrical outer base surface having a non-circular cross-section and aligned with said support surface.

9. A portable electric fan according to claim 8 wherein said cross-sections of said support surface and said base surface are matching ellipses.

10. A portable electric fan according to claim 1 wherein said support means comprises a cylindrical outer support surface having a non-circular cross-section, and said base means comprises a cylindrical outer base surface having a non-circular cross-section and aligned with said support surface.

11. A portable electric fan according to claim 10 wherein said cross-sections of said support surface and said base surface are matching ellipses.

12. A portable electric fan according to claim 11 wherein each of said coupling surfaces is inclined.

13. A portable electric fan according to claim 12 including detent means for establishing a plurality of predetermined different relative rotational positions between said coupling surface in response to rotation of said support relative to said base means.

14. A portable electric fan according to claim 13 wherein said detent means comprises a first gear fixed to said base means and a second gear fixed to said support means and engaged with said first gear.

15. A portable electric fan according to claim 14 wherein one of said first and second gears is a rack gear having a plurality of annularly spaced apart teeth, and the other of said first and second gears comprises at least one tooth sequentially engageable with said teeth during rotation of said support means relative to said base means.

16. A portable electric fan according to claim 10 wherein each of said outer base surface and said outer support surface is a truncated cylinder.

17. A portable electric fan according to claim 16 including an on-off electrical switch operatively connected to said electric motor, and wherein said truncated outer support surface includes longitudinally projecting portions of length uniformly varying between maximum and minimum values, and said switch is retained by a said portion having said length of said maximum value.

18. A portable electric fan according to claim 17 wherein said outer base surface defines vent openings communicating with said housing means.

19. A portable electric fan according to claim 17 wherein said cross-sections of said support surface and said base surface are matching ellipses.

20. A portable electric fan according to claim 19 wherein each of said coupling surfaces is inclined.

* * * * *